United States Patent [19]

Aldridge et al.

[11] Patent Number: 4,793,916

[45] Date of Patent: Dec. 27, 1988

[54] COAL LIQUEFACTION PROCESS

[75] Inventors: Clyde L. Aldridge; Roby Bearden, Jr., both of Baton Rouge, La.

[73] Assignee: Exxon Research and Engineering Company, Florham Park, N.J.

[21] Appl. No.: 33,682

[22] Filed: Apr. 3, 1987

Related U.S. Application Data

[63] Continuation-in-part of Ser. No. 773,596, Sep. 9, 1985, abandoned, which is a continuation-in-part of Ser. No. 682,379, Dec. 17, 1984, abandoned.

[51] Int. Cl.[4] ..... C10G 1/08

[52] U.S. Cl. ..... 208/421; 208/420

[58] Field of Search ..... 208/420, 421

[56] References Cited

U.S. PATENT DOCUMENTS 4,077,867 3/1978 Aldridge et al. ..... 208/420
4,111,787 9/1978 Aldridge et al. ..... 208/421
4,244,839 1/1981 Aldridge et al. ..... 280/421
4,313,818 2/1982 Aldridge et al. ..... 208/420
4,578,182 3/1986 Bearden, Jr. et al. ..... 208/421

*Primary Examiner*—H. M. S. Sneed
*Assistant Examiner*—George R. Fourson
*Attorney, Agent, or Firm*—Marthe L. Gibbons; Henry E. Naylor

[57] ABSTRACT

An improved process is provided for hydroconverting of coal in which a hydrocarbon-dispersible chromium compound is mixed with a hydrocarbonaceous material, in the absence of coal, to form a high metals-containing catalyst precursor concentrate which is heated in the presence of a hydrogen sulfide-containing gas to form a solid chromium-containing catalyst. A portion of the concentrate containing the catalyst is introduced into a diluent to which coal is added or in which coal is present. The resulting mixture is subjected to hydroconversion conditions to convert the coal to a hydrocarbonaceous oil product.

10 Claims, 1 Drawing Sheet

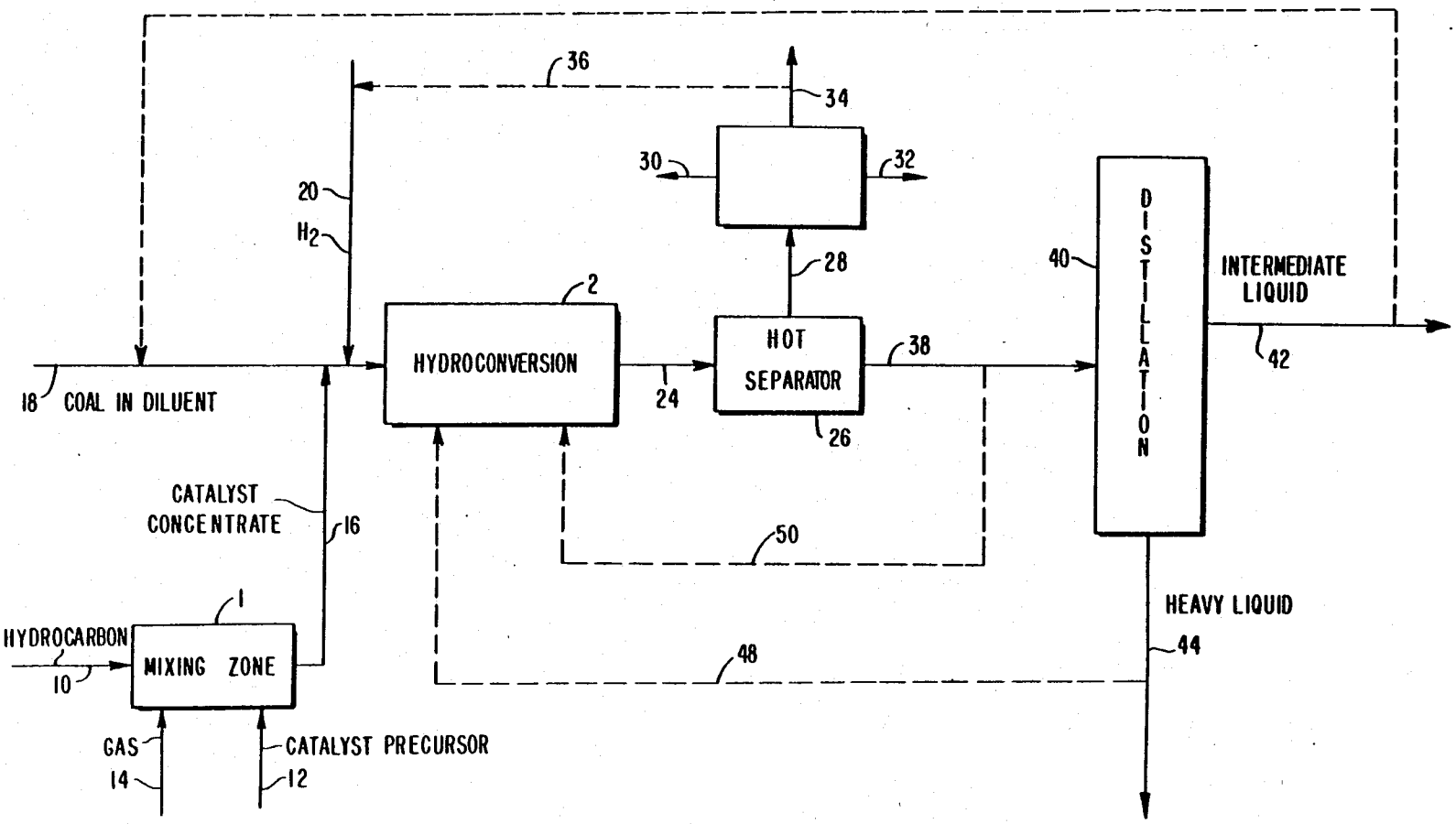
INTERMEDIATE LIQUID
42
HEAVY LIQUID
44
DISTILLATION
40
38
32
34
28
HOT SEPARATOR
26
50
48
30
24
36
2
HYDROCONVERSION
20
$H_2$
16
CATALYST PRECURSOR
12
CATALYST CONCENTRATE
1
MIXING ZONE
COAL IN DILUENT
18
GAS
14
HYDROCARBON
10

COAL LIQUEFACTION PROCESS

CROSS REFERENCE TO RELATED APPLICATIONS

This application is a Continuation-in-Part of U.S. Ser. No. 773,596, filed Sept. 9, 1985, now abandoned, which is a Continuation-in-Part of U.S. Ser. No. 682,379 filed Dec. 17, 1984, now abandoned, the teachings of which are hereby incorporated by reference.

BACKGROUND OF THE INVENTION

1. Field of the Invention

This invention relates to an improvement in a slurry hydroconversion process in which coal is hydroconverted to liquid products utilizing a chromium-containing catalyst prepared from catalyst precursor dispersed in a hydrocarbon.

2. Description of Information Disclosures

Slurry coal hydroconversion processes (i.e., coal liquefaction) utilizing a catalyst prepared in a hydrocarbonaceous oil from a thermally decomposable or oil soluble chromium compound catalyst precursor are known. See, for example, U.S. Pat. Nos. 4,077,867 and 4,369,106. The term "hydroconversion" with reference to coal is used herein to designate a catalytic conversion of coal to liquid hydrocarbonaceous product in the presence of hydrogen.

It has now been found that the activity of the chromium catalyst can be increased when the chromium catalyst is preformed in a hydrocarbonaceous medium at concentrations greater than 0.1 wt. % (1000 ppm) Cr, in the absence of coal. The preformed catalyst in the hydrocarbonaceous medium is added to the diluent in which the coal is dispersed.

SUMMARY OF THE INVENTION

In accordance with the invention, there is provided a process for hydroconverting coal in a slurry comprising coal and a diluent, which comprises the steps of: (a) forming a mixture of a hydrocarbonaceous oil and a hydrocarbon-dispersible chromium compound in an amount ranging from about 0.1 to about 2 weight percent, calculated as elemental metal, based on said hydrocarbonaceous oil; (b) heating the mixture resulting from step (a) in the presence of a hydrogen sulfide-containing gas, in the absence of coal, at conditions, including a temperature ranging from about 500° to 779° F., to convert said chromium compound to a chromium-containing solid catalyst in said hydrocarbonaceous oil; (c) adding at least a portion of said hydrocarbonaceous oil comprising said catalyst resulting from step (b) to said diluent; (d) adding coal to said diluent before step (d), or after step (c); (e) subjecting the mixture resulting from step (d), said mixture comprising said solid chromium-containing catalyst and said coal, to hydroconversion conditions, including a temperature ranging from about 800° to 900° F., in the presence of hydrogen and (f) recovering a normally liquid hydrocarbonaceous product.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a hydrocarbonaceous oil is introduced by line 10 into mixing zone 1. Suitable hydrocarbonaceous oils for introduction into mixing zone 1 which may serve as catalyst preparation zone include a single type of hydrocarbonaceous oil, such as a hydrocarbon, or mixtures of hydrocarbonaceous materials having an initial boiling point of at least about 500° F. All boiling points referred to herein are atmospheric pressure equivalent boiling points unless otherwise specified. Instead of using one zone such as mixing zone 1 as both mixing and catalyst preparation zone, a separate catalyst preparation zone or vessel could be used after mixing zone 1 to prepare the catalyst (i.e. convert the catalyst precursor to the solid catalyst). Preferably, the hydrocarbonaceous oil of line 10 will comprise a hydrocarbonaceous oil having constituents boiling above 1050° F., more preferably having at least 10 weight percent constituents boiling above 1050° F., such as crude oils, atmospheric residua boiling above 650° F., vacuum residua boiling above 1050° F. Most preferably, the hydrocarbonaceous oil of line 10 is a blend of at least two oils, namely, a lighter boiling oil having a boiling point below about 975° F. and a heavier oil having a boiling point above about 975° F. and the blend comprising at least about 10 weight percent, preferably at least about 25 weight percent materials boiling above 1050° F. Preferred concentrations of the heavier oil in the blend include from 25 to 90 weight percent heavier oil, most preferably from 45 to 75 weight percent heavier oil, based on the oil of the blend (mixture of oils). The light oil may be a gas oil and the heavier oil may be a vacuum residuum. Alternatively, an atmospheric residuum having the appropriate amount of desired constituents may be used as the hydrocarbonaceous oil of line 10. The hydrocarbonaceous material carried in line 10 may be derived from any source, such as petroleum, tarsand oil, shale oil, liquids derived from coal liquefaction processes and mixtures of any of these oils. Generally, these oils have a Conradson carbon content ranging from about 5 to about 50 weight percent (as to Conradson carbon content, see ASTM Test D 189-65). A hydrocarbon-dispersible chromium compound (catalyst precursor) is introduced into mixing zone 1 by line 12. The hydrocarbon-dispersible chromium compound may be a compound that is soluble in the hydrocarbonaceous oil (e.g. oil soluble) or a compound that is soluble in an other organic compound (liquid medium) that can be dispersed in the hydrocarbonaceous oil or a compound that is water soluble and wherein the aqueous solution can be dispersed in the hydrocarbonaceous oil. The hydrocarbon-dispersible chromium compound introduced by line 12 may be in a phenolic medium, in water, alcohol, etc. Suitable hydrocarbon-dispersible chromium compounds convertible (under preparation conditions) to a solid chromium-containing catalyst include: (1) inorganic chromium compounds such as oxides, carbonyls, halides, oxyhalides; (2) chromium salts of organic acids such as acyclic and cylic aliphatic carboxylic acids and thiocarboxlic acids containing two or more carbon atoms (e.g., naphthenic acids); aromatic carboxylic acids (e.g. toluic acid); sulfonic acids (e.g., toluenesulfonic acid); sulfinic acids; mercaptans; xanthic acids; phenols, di-and polyhydroxy aromatic compounds; (3) organometallic compounds, such as chromium chelates, e.g., with 1,3-diketones, ethylene diamine, ethylenediaminetetraacetic acid, phthalocyanines, etc. (4) chromium salts of organic amines such as aliphatic amines, aromatic amines and quaternary ammonium compounds. The preferred chromium compound is chromic acid. A hydrogen sulfide-containing gas is introduced into mixing zone 1 by line 14. The gas may comprise from 1 to 100 mole percent $H_2S$. Preferably, the gas comprises hydrogen and from about 1 to about 90 mole percent hydrogen sulfide based on the total gas. A sufficient amount of the hydrocarbon-dispersible chromium compound (catalyst precursor) is introduced into mixing zone 1 to form a catalyst precursor concentrate, that is, a mixture comprising from about 0.1 to about 2, preferably from about 0.2 to about 2 more preferably from about 0.2 to 1, and most preferably from about 0.3 to 1, weight percent chromium, calculated as elemental metal, based on the weight of the hydrocarbonaceous material (liquid medium) in the mixture. In accordance with the invention, coal should not be present in mixing zone 1, or in any subsequent zone that may be used as catalyst preparation zone. The mixture of hydrocarbon-dispersible chromium compound and hydrocarbonaceous material (catalyst precursor concentrate) is heated in mixing zone 1 or in a separate catalyst preparation zone to a temperature sufficient to convert the hydrocarbon-dispersible chromium compound (catalyst precursor) to a solid chromium-containing catalyst. Suitable catalyst preparation conditions include a temperature ranging from about 500 to about 779, preferably a temperature ranging from about 650° to about 779° F., more preferably a temperature ranging from about 680° to 730° F., and a total pressure ranging from about 50 to about 5000 psig, preferably, a total pressure ranging from about 100 to about 2000 psig to convert the hydrocarbon dispersible chromium compound to a solid catalyst comprising chromium. The resulting catalyst concentrate (i.e., solid catalyst particles dispersed in the hydrocarbonaceous material) is removed by line 16 from mixing zone 1. At least a portion of the catalyst concentrate is introduced into line 18 which carries a slurry comprising coal and a diluent. It should be noted that the catalyst concentrate of line 16 could be introduced into the diluent before the coal has been added to the diluent, or simultaneously while the coal is being added to the diluent or as shown in the FIGURE, the catalyst concentrate can be added to the diluent which already comprises the coal particles. The term "coal" is used herein to designate a normally solid carbonaceous material including all ranks of coal such as anthracite coal, bituminous coal, semibituinous coal, lignite, peat and mixtures thereof. The diluent in the practice of the present invention may be any of the known diluents for use in chargestocks to coal liquefaction processes, such as, for example, those described in U.S. Pat. No. 4,094,765, column 1, line 54 to column 2, line 43. Typically, the diluent will be a hydrocarbonaceous stream derived from a coal liquefaction process, for example, an intermediate boiling product stream such as a portion of the hydrocarbon fraction having an initial boiling point within the range from 350 to 650 and a final boiling point within the range of 700° to 1100° F. recycled as diluent (e.g. line 42) or a product bottoms stream from the process of the present invention. The hydrocarbonaceous bottoms may have an initial boiling point as low as 350° F., preferably as low as 550° F., more preferably as low as at least 700° F. The catalyst concentrate disperses in the diluent carried in line 18. A hydrogen-containing gas is introduced by line 20 into line 18. The mixture of coal, diluent, catalyst concentrate and hydrogen is passed by line 18 into hydroconversion zone 2 (i.e., coal liquefaction zone). The catalyst concentrate of line 16 is added to the coal-diluent mixture in an amount sufficient to provide from about 10 to about 2000 wppm chromium, preferably from about 50 to about 1000 wppm chromium, calculated as elemental metal, based on the weight of the coal only.

Suitable hydroconversion operating conditions are summarized in Table I:

TABLE I

| Conditions | Broad Range | Preferred Range |
|---|---|---|
| Temperature, °F. | 800–900 | 820–870 |
| Total Pressure, psig | 500–7000 | 1150–2500 |
| $H_2$ Partial Pressure, psig | 400–5000 | 1000–1600 |

Reaction times of about 5 minutes to several hours may be used. If desired, the hydroconversion can be conducted with staged temperatures. Contact of the mixture of coal, diluent and catalyst under hydroconversion conditions in the reaction zone with a hydrogen-containing gas effects hydroconversion of at least a portion of the coal to a hydrocarbonaceous oil. The hydroconversion zone effluent, which comprises the hydroconverted oil product and catalytic solids, is removed by line 24 and introduced into hot separator 26. The overhead of the hot separator is passed by line 28 into gas separator 30. A light liquid hydrocarbon stream is removed from the gas separator by line 32. A gas is removed by line 34. A portion of the gas may be recycled to the hydroconversion zone by line 36. Intermediate liquid hydrocarbons, heavy hydrocarbons and solids are removed by line 38 from hot separator 26 and introduced into distillation zone 40. If desired, solids may be removed from this stream prior to introducing it into distillation zone 40. An intermediate liquid hydrocarbonaceous stream is removed from distillation zone 40 by line 42 or portion of this stream may be recycled to line 18 to serve a diluent for the coal-diluent slurry. A heavy liquid hydrocarbonaceous stream, which may comprise solids (if the solids were not previously removed) is removed from distillation zone 40 by line 44. If desired, a portion of the stream from line 44 may be recycled to hydroconversion zone 2 via line 48. Furthermore, if desired, at least a portion of stream 38 may be recycled to the hydroconversion zone 2 via line 50 and/or to mixing zone 1 either with or without intervening removal of solids. Furthermore, if desired, at least a portion of the solids removed from any of the hydroconversion effluent streams may be recycled to the hydroconversion zone or to the mixing zone.

Catalyst Concentrate Preparation I (Run 326L)

To a one-liter magnetically stirred Autoclave Engineers autoclave was charged 400 g of heavy Arabian atmospheric residuum (HAAR) together with 30.77 g of 5 wt. % $CrO_3$ in water. The autoclave was flushed with nitrogen and pressured to 250 psig with nitrogen and heated to 200° C. with stirring, whereupon a flow of 120 liters of nitrogen flow was passed through the autoclave at the rate of 2 liters per minute to distill the water from the mixture. At this point the nitrogen flow was stopped and the pressure lowered to atmospheric. The nitrogen flow was started again at the rate of 1.5 liter/min. and continued until 75 liters had been flowed through the autoclave to complete the drying. The autoclave was then cooled to room temperature. At this point the contents of the autoclave was a chromium-in-heavy Arabian atmospheric residuum at a concentration of 2000 wppm.

This catalyst precursor was then given a sulfiding treatment as follows. The autoclave was pressured to 125 psig with $H_2S$ and then to 1250 psig with $H_2$ at room temperature. The autoclave was then heated to 380° C. with stirring and maintained at 380°-385° C. for thirty minutes with stirring, followed by cooling to room temperature. The pressure was released and the autoclave discharged to yield a sulfided chromium catalyst concentrate in HAAR at 2000 wppm Cr content.

Catalyst Precursor Concentrate Preparation II, Run 323L

A chromium in heavy Arabian atmospheric residuum was prepared similar to Preparation I except that the sulfiding treatment was omitted.

Catalyst Precursor Concentrate Preparation III, Run 417L

To a one-liter magnetically stirred Autoclave Engineers autoclave was charged 380 g of Heavy Arabian Atmospheric Residuum (HAAR) together with 20.0 g of chromium naphthenate (4.0 wt. % Cr) obtained from Shepherd Chemical Company. The autoclave was flushed with $N_2$ and heated to 100° C. with stirring and stirred at this temperature for 15 min., then cooled to room temperature to yield a catalyst precursor concentrate containing 2000 wppm Cr.

Catalyst Concentrate Preparation IV, Run 418L

After withdrawing a sample of Preparation III for testing, 300 g of Preparation III was left in the autoclave and given a sulfiding treatment as follows. The autoclave was flushed with $H_2$ and pressured to 125 psig with $H_2S$ and then to 1250 psig with $H_2$ at room temperature. The autoclave was heated with stirring to 380° C. and maintained at 380°-385° C. for thirty minutes with stirring, followed by cooling to room temperature. The pressure was released and the autoclave discharged to yield a sulfided chromium catalyst concentrate in HAAR at 2000 wppm Cr content.

Catalyst Concentrate Preparation V (Run 411L)

A catalyst concentrate was prepared according to the procedure of catalyst preparation I except that the hydrocarbon medium was 43.6 wt. % 650°-1000° F. coal liquids and 56.4 wt. % heavy Arabian vacuum residuum.

Catalyst Concentrate Preparation VI (Run 422L)

To a one-liter magnetically stirred Autoclave Engineers autoclave was charged 380 g of heavy Arabian vacuum gas oil together with 20.0 g of chromium naphthenate (4.0 wt. % Cr) obtained from Shepherd Chemical Company. The autoclave was flushed with $H_2$ and pressured to 125 psig with $H_2S$ and then to 1250 psig with $H_2$ at room temperature. The autoclave was heated with stirring to 380° C. and maintained at 380°-385° C. for thirty minutes with stirring, followed by cooling to room temperature. The pressure was released and the autoclave discharged to yield a sulfided chromium catalyst concentrate in heavy Arabian vacuum gas oil at 2000 wppm Cr. content.

Example 1 (Run 882)

To a 300 cc Autoclave Engineers magnetically stirred autoclave was charged 41.00 g of 100 mesh Wyodak coal together with 41.00 g of 1-methyl naphthalene diluent and 2.19 g of catalyst concentrate preparation I to provide 107 wppm Cr on coal. The autoclave was flushed with hydrogen then pressured to 100 psig with $H_2S$ to a total of 2700 psig with hydrogen. The autoclave was then heated to 820° F. with stirring and maintained at this temperature with stirring for 90 minutes, after which the autoclave was cooled and the gases collected. The contents of the autoclave were filtered and the autoclave washed with 300 cc toluene, which washings were also filtered. The combined solids were washed with an additional 500 cc of toluene and dried in a vacuum oven at 100° C. for one hour. The recovered dry solids (unconverted coal) weighed 5.84 g or 14.2 wt. % on coal feed (including the 9.75 wt. % ash contained in the coal feed).

Comparative Example A (Run 793)

To a 300 cc Autoclave Engineers magnetically stirred autoclave was charged 41.00 g of 100 mesh Wyodak coal together with 41.00 g of one-methyl naphthalene diluent and 2.19 g of catalyst precursor concentrate preparation II to provide 107 wppm Cr on coal. The autoclave was flushed with hydrogen then pressured to 100 psig with $H_2S$ and then to a total of 2700 psig with hydrogen. The autoclave was then heated to 820° F. with stirring and maintained at this temperature with stirring for 90 minutes, after which the autoclave was cooled and gases collected. The contents of the autoclave were filtered and the autoclave washed with 300 cc toluene, which washings were also filtered. The combined solids were washed with an additional 500 cc of toluene and dried in a vacuum oven at 100° C. for one hour. The yield of unconverted coal was 9.91 g or 24.2 wt. % coal feed (including the 9.75 wt. % ash contained in the coal feed).

Comparative Example B (Run 1112)

To a 300 cc Autoclave Engineering magnetically stirred autoclave was charged 41.00 g of 100 mesh Wyodak coal together with 41.00 g of one-methyl naphthalene diluent and 2.19 g of catalyst precursor concentrate preparation II to provide 107 wppm Cr on coal.

The combined mixture of catalyst precursor concentrate II, coal and diluent was given a sulfiding pretreatment as follows. The autoclave was flushed with hydrogen, the pressured to 125 psig with $H_2S$ and then pressured to a total pressure of 1250 psig with hydrogen at room temperature. The autoclave was then heated to 380° C. with stirring and maintained at 380°-385° C. for thirty minutes followed by cooling to room temperature. The autoclave gases were then vented.

The autoclave was then flushed with hydrogen and pressured to 100 psig with $H_2S$ and then to a total of 2700 psig with hydrogen. The autoclave was then heated to 820° F. with stirring and maintained at this temperature with stirring for 90 minutes, after which the autoclave was cooled and gases collected. The contents of the autoclave were filtered and the autoclave washed with 300 cc toluene, which washings were also filtered. The combined solids were washed with an additional 500 cc of toluene and dried in a vacuum oven at 100° C. for one hour. The yield of unconverted coal was 8.10 g or 19.8 wt. % on coal feed (including the 9.75 wt. % ash contained in the coal feed).

Example 2 Run (1103)

A liquefaction experiment on Wyodak coal was carried out according to the procedure of Example 1 except catalyst concentrate IV was used. The yield of unconverted coal was 5.93 g or 14.5 wt. % on coal feed (including the 9.75 wt. % ash contained in the coal feed).

Comparative Example C (Experiment 1104)

A liquefaction experiment on Wyodak coal was carried out according to the procedure of comparative Example A except that catalyst precursor concentrate III was used. The yield of unconverted coal was 8.95 g or 21.8 wt. % on coal feed (including the 9.75 wt. % ash contained in the coal feed).

Comparative Example D (Run 1111)

A liquefaction experiment on Wyodak coal was carried out according to the procedure of comparative Example B except catalyst precursor concentrate III was used. the yield of unconverted coal was 8.18 g or 20.0 wt. % on coal feed (including the 9.75 wt. % ash contained in the coal feed).

Example 3 (Run 1070)

A liquefaction experiment on Wyodak coal was carried out according to the procedure of Example 1 except catalyst concentrate V was used. The yield of unconverted coal was 5.99 g or 14.6 wt. % on coal feed (including the 9.75 wt. % ash in the coal feed).

Example 4 (Run 1108)

A liquefaction experiment on Wyodak coal was carried out according to the procedure of Example 1 except catalyst concentrate VI was used. The yield of unconverted coal was 6.9 g or 17.0 wt. % on coal feed (including the 9.75 wt. % ash in the coal feed).

Comparative Example E (Run 786)

A liquefaction experiment on Wyodak coal was carried out according to the procedure of Comparative Example "A" except that the chromium catalyst precursor was supplied as 0.844 g of a 1% $CrO_3$ solution in water to provide 107 wppm Cr on coal. The yield of unconverted coal was 9.18 g or 22.4 wt. % on coal feed (including the 9.75 wt. % ash contained in the coal feed).

The results of these experiments are summarized in Table II.

| Example of Invention | Comparative Example | Concentrate Preparation Number | Concentrate Preparation Medium | Cr Source | Sulfiding Treat Prior To Coal Liquefaction Reaction | Unconverted[d] Coal, Wt. % On Coal Feed |
|---|---|---|---|---|---|---|
| 1 | | I | HAAR[a] | 5% $CrO_3/H_2O$ | Yes, in absence of coal | 14.2 |
| | A | II | HAAR | " | No | 24.2 |
| | B | II | HAAR | " | Yes, in presence of coal | 19.8 |
| 2 | | IV | HAAR | Cr Naphthenate | Yes, in absence of coal | 14.5 |
| | C | III | HAAR | " | No | 21.8 |
| | D | III | HAAR | " | Yes, in presence of coal | 20.0 |
| 3 | | V | 43.6 wt. % 650–1000° F. coal liquid, 56.4 wt. % HAVR[b] | 5% $CrO_3/H_2O$ | Yes, in absence of coal | 14.6 |
| 4 | | VI | HAVGO[c] | Cr Naphthenate | Yes, in absence of coal | 17.0 |
| | E | — | — | 1% $CrO_3/H_2O$ | No | 22.4 |

[a]HAAR = Heavy Arabian Atmospheric Residuum
[b]HAVR = Heavy Arabian Vaccum Residuum
[c]HAVGO = Heavy Arabiam Vacuum Gas Oil
[d]Includes the 9.75 wt. % ash on Coal Food.

As can be seen from these experiments, the catalysts of examples 1, 2, 3 and 4, which were prepared in accordance with the invention, by heating a catalyst precursor concentrate in the presence of $H_2S$ and in the absence of coal and subsequently introducing the resulting $H_2S$ treated catalyst concentrate into the diluent-coal slurry was more active than the comparative catalysts.

Catalyst Concentrate Preparation VII, Run 435L

A sulfided chromium catalyst concentrate was prepared in a manner identical in all respects to Preparation I above except that 3.08 g of 5 wt. % $CrO_3$ in water was used instead of 30.77 g. The resultant sulfided chromium catalyst concentrate in HAAR contained 200 wppm Cr.

Comparative Example F (Run 1463)

The catalyst concentrate of Preparation VII was tested according to the procedure of Example 1 hereof. The charge was 41.00 g of 100 mesh Wyodak coal together with 21.29 g of 1-methyl naphthalene and 21.9 g of the catalyst concentrate preparation VII to provide 107 wppm Cr on coal. Test conditions were identical to Example 1 and the total charge of liquid, i.e. 1-methyl naphthalene and resid diluent, was 43.19 g as in Example 1. The recovered dry solids (unconverted coal) weighted 11.16 g or 27.2 wt. % on coal feed (including the 9.75 wt. % ash contained in the coal feed). Table III below shows a side by side comparison of the above two examples.

TABLE III

| | Example 1 (Run 882) | Comparative Example F (Run 1463) |
|---|---|---|
| Concentration of Cr in Catalyst Preparation in HAAR, wppm | 2000 | 200 |

TABLE III-continued

| | Example 1 (Run 882) | Comparative Example F (Run 1463) |
|---|---|---|
| Cr on coal, wppm | 107 | 107 |
| Unconverted coal[a] wt. % on coal feed | 14.2 | 27.2 |

[a]Includes the 9.75 wt. % ash on coal feed

The above Table illustrates the present invention wherein the preparation of a chromium catalyst at high concentration in oil, e.g. resid, shows a higher degree of activity than a chromium catalyst prepared at low concentration. In other words, a chromium catalyst prepared as a dilute dispersion in resid is essentially inactive compared to a dispersion prepared at high concentration. We believe the reason for this is that chromium is especially sensitive to conversion to an inactive form by certain impurities, especially oxygenated compounds, before sulfiding to an active catalyst can be accomplished. Thus, while it is necessary to have an oil diluent in order to handle and disperse the chromium catalyst, the amount of this diluent, e.g. resid, must be severely limited to prevent conversion of the chromium to an inactive unsulfied form.

What is claimed is:

1. A process for hydroconverting coal to liquid products, in a slurry comprising coal and a diluent, which process comprises the steps of:

(a) forming a mixture of a hydrocarbonaceous oil and a hydrocarbon-dispersible chromium compound in an amount ranging from about 0.1 to about 2 weight percent, calculated as elemental metal, based on said hydrocarbonaceous oil;

(b) heating the mixture resulting from step (a) in the presence of a hydrogen sulfide-containing gas in the absence of coal, at conditions including a temperature ranging from about 500° to 779° F., to convert said chromium compound to a chromium-containing solid catalyst in said hydrocarbonaceous oil;

(c) adding at least a portion of said hydrocarbonaceous oil comprising said catalyst resulting from step (b) to said diluent;

(d) adding coal to said diluent before step (c), after step (c), or simultaneously with step (c);

(e) subjecting the mixture resulting from step (d), said mixture comprising said solid chromium-containing catalyst and said coal to a temperature ranging from about 800° to about 900° F., and a hydrogen partial pressure from about 400 to about 5,000 psig and (f) recovering a liquid hydrocarbonaceous product.

2. The process of claim 1 wherein said hydrocarbonaceous oil of step (a) comprises material boiling above 1050° F.

3. The process of claim 1 wherein said hydrocarbonaceous oil of step (a) comprises a blend of at least a lighter boiling oil and a heavier oil, said lighter oil boiling below about 975° F. and said heavier oil boiling above about 975° F., said blend comprising at least about 10 weight percent materials boiling above 1050° F.

4. The process of claim 1 wherein said hydrocarbon-dispersible chromium compound is mixed with said hydrocarbonaceous oil of step (a) in an amount ranging from about 0.2 to about 2 weight percent, calculated as elemental metal, based on said hydrocarbonaceous oil.

5. The process of claim 1 wherein said hydrocarbon-dispersible chromium compound is selected from the group consisting of inorganic chromium compounds, salts of organic acids, organometallic compounds, salts of organic amines and mixtures thereof.

6. The process of claim 1 wherein said hydrocarbon-dispersible chromium compound is chromic acid.

7. The process of claim 1 wherein said gas of step (b) comprises hydrogen and from about 1 to about 90 mole percent hydrogen sulfide.

8. The process of claim 1 wherein said hydrocarbon-dispersible chromium compound is converted to said catalyst in step (b) at a temperature ranging from about 650° to 779° F. and a total pressure ranging from about 50 to about 5000 psig.

9. The process of claim 1 wherein said hydroconversion conditions of step (e) include a temperature ranging from about 820° to about 870° F. and a total pressure ranging from about 500 to about 7000 psig.

10. The process of claim 1 wherein said portion of hydrocarbonaceous oil comprising said solid chromium-containing catalyst is introduced into said diluent in an amount sufficient to provide from about 10 to about 2000 wppm chromium, calculated as elemental metal, based on said coal.

* * * * *